US005477922A

United States Patent [19]

Rochon

[11] Patent Number: 5,477,922

[45] Date of Patent: Dec. 26, 1995

[54] METHOD OF EVALUATING THE DAMAGE TO THE STRUCTURE OF ROCK SURROUNDING A WELL

[75] Inventor: Jean Rochon, Pau, France

[73] Assignee: Elf Aquitaine Production, France

[21] Appl. No.: 311,591

[22] Filed: Sep. 23, 1994

[30] Foreign Application Priority Data

Sep. 30, 1993 [FR] France ..... 93 11665

[51] Int. Cl.[6] ..... E21B 49/08

[52] U.S. Cl. ..... 166/250.02; 73/155

[58] Field of Search ..... 166/250, 252; 73/155, 151

[56] References Cited

U.S. PATENT DOCUMENTS

| | | | |
|---|---|---|---|
| 3,550,445 | 12/1970 | Kiej | 166/250 X |
| 3,604,256 | 9/1971 | Prats | 73/155 |
| 3,636,762 | 1/1972 | Kuo et al. | 73/155 |
| 4,052,885 | 10/1977 | Shuck | 73/38 |
| 4,423,625 | 1/1984 | Bostic, III et al. | 166/250 X |
| 4,558,592 | 12/1985 | Despax et al. | 73/151 |
| 4,597,290 | 7/1986 | Bourdet et al. | 166/250 X |
| 4,862,962 | 9/1989 | Prouvost | 166/250 |
| 4,867,237 | 9/1989 | Wilson et al. | 166/250 |

FOREIGN PATENT DOCUMENTS

| | | |
|---|---|---|
| 0286152 | 10/1988 | European Pat. Off. . |
| 2623561 | 5/1989 | France . |
| 2060903 | 5/1981 | United Kingdom . |

*Primary Examiner*—Stephen J. Novosad
*Attorney, Agent, or Firm*—Bacon & Thomas

[57] ABSTRACT

Method for evaluating the damage to the structure of rock surrounding a well, comprising the following steps: injection into the rock, which is already saturated with a first fluid having a first viscosity, of an oil with higher viscosity than the first viscosity; recording the pressure of the injected oil as a function of time; and analysis of the change in the pressure of the injected oil in order to deduce the different-permeability regions present in the rock.

8 Claims, 8 Drawing Sheets

METHOD OF EVALUATING THE DAMAGE TO THE STRUCTURE OF ROCK SURROUNDING A WELL

BACKGROUND OF THE INVENTION

The present invention relates to a method for evaluating the damage to the structure of rock surrounding a well, and more particularly to such a method intended to evaluate the damage to the bottom of an oil well.

DESCRIPTION OF RELATED ART

During oil drilling, as the well is bored, metal piping is lowered into the well in order to reinforce the wall of the well and isolate the inside of the well from the various rock layers through which the well passes. The annular space defined between the outside of the piping and the wall of the well is filled with cement in order further to reinforce the well, and to prevent communication of fluids between the layers.

Once the well is completed, the inside of the well must be set in communication with the neighbouring oil-bearing rock layer. In order to do this, a perforation tool is lowered to the bottom of the well at the oil-bearing rock. The tool is fitted with explosive charges which are intended successively to perforate the piping, the cement layer and the oil-bearing rock. The opening or perforation which extends into the rock is surrounded by a damaged region with permeability lower than that of the oil-bearing rock.

It is also possible to use a cutting tool fitted with blades which, when the tool is rotated at the bottom of the well, cut a section of the casing and of the wall of the well in order to create an opening in the oil-bearing rock. This opening or "window" is also surrounded by a damaged region.

When crude oil passes from the oil-bearing rock into the well through the perforations, excessive damage to the neighbouring region considerably reduces the productivity of the well. In the event that the damaged region is highly compacted, with the result being permeability which is too low, it is expedient either to recommence the perforation operation or to execute measures, such as acidification, in order to facilitate the flow of the crude oil.

SUMMARY OF THE INVENTION

The subject of the present invention is therefore a method for evaluating the damage to the structure of rock surrounding a well, which makes it possible to quantify the permeability of the damaged region bounding a perforation, and more generally the well.

For this purpose, the invention proposes a method for evaluating the damage to the structure of rock surrounding a well, comprising the following steps:

injection into the rock, which is already saturated with a first fluid having a first viscosity, of an oil with higher viscosity than the first viscosity, recording the pressure of the injected oil as a function of time, analysis of the change in the pressure of the injected oil in order to deduce the different-permeability regions present in the rock.

The present invention thus makes it possible to evaluate the damage to the structure of rock surrounding a well, with the damaged region resulting either from the operation of drilling the well or from perforation or cutting of the rock.

Other characteristics and advantages of the present invention will emerge more clearly on reading the description hereinbelow, made with reference to the attached drawings,

DESCRIPTION OF THE PREFERRED EMBODIMENT

Figure 1:
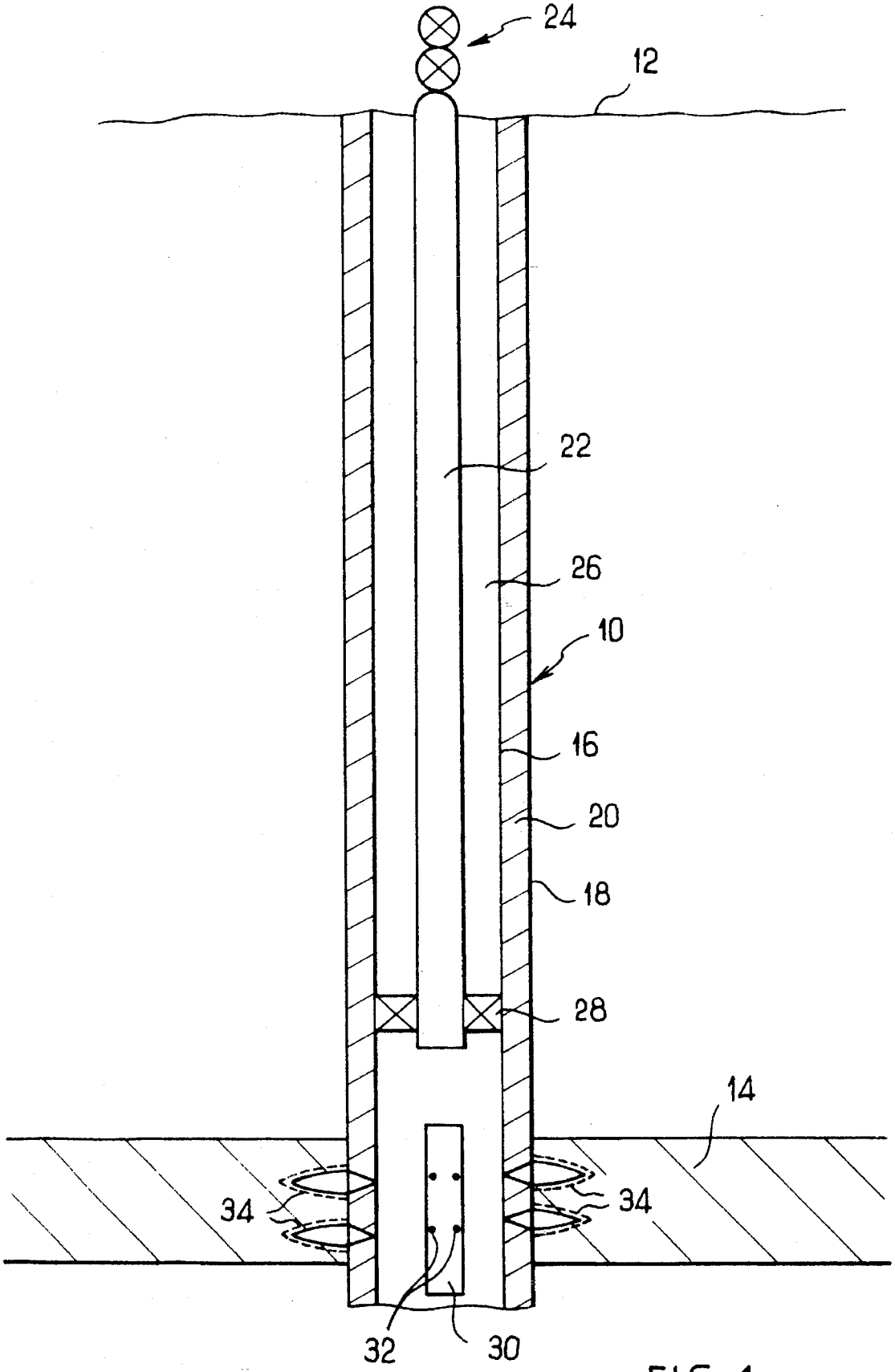
FIG. 1 is a schematic representation, in longitudinal section, of an oil well.

As represented in FIG. 1, a well 10 which, in the example illustrated, is an oil well, extends from the surface 12 to an oil-bearing rock layer 14. A metal casing 16 extends inside the well 10 and the annular space defined between the outside of the casing 16 and the wall 18 of the well 10 is filled with cement 20. A production column 22, arranged in a known manner in the well 10, is fitted, at its upper end, with a set of safety valves 24. The annular space 26 defined between the production column 22 and the piping 16 is closed, at its lower end, by a sealing device 28, more commonly called a packer.

When starting production of the well, a perforating tool 30 is lowered into the well 10 via the production column 22 as far as the level of the oil-bearing rock 14. Explosive charges 32 arranged in the perforating tool 30 are then detonated. The explosion of the charges 32 creates perforations 34 through the piping 16 and the cement 18, extending into-the oil-bearing rock 14.

Figure 2:
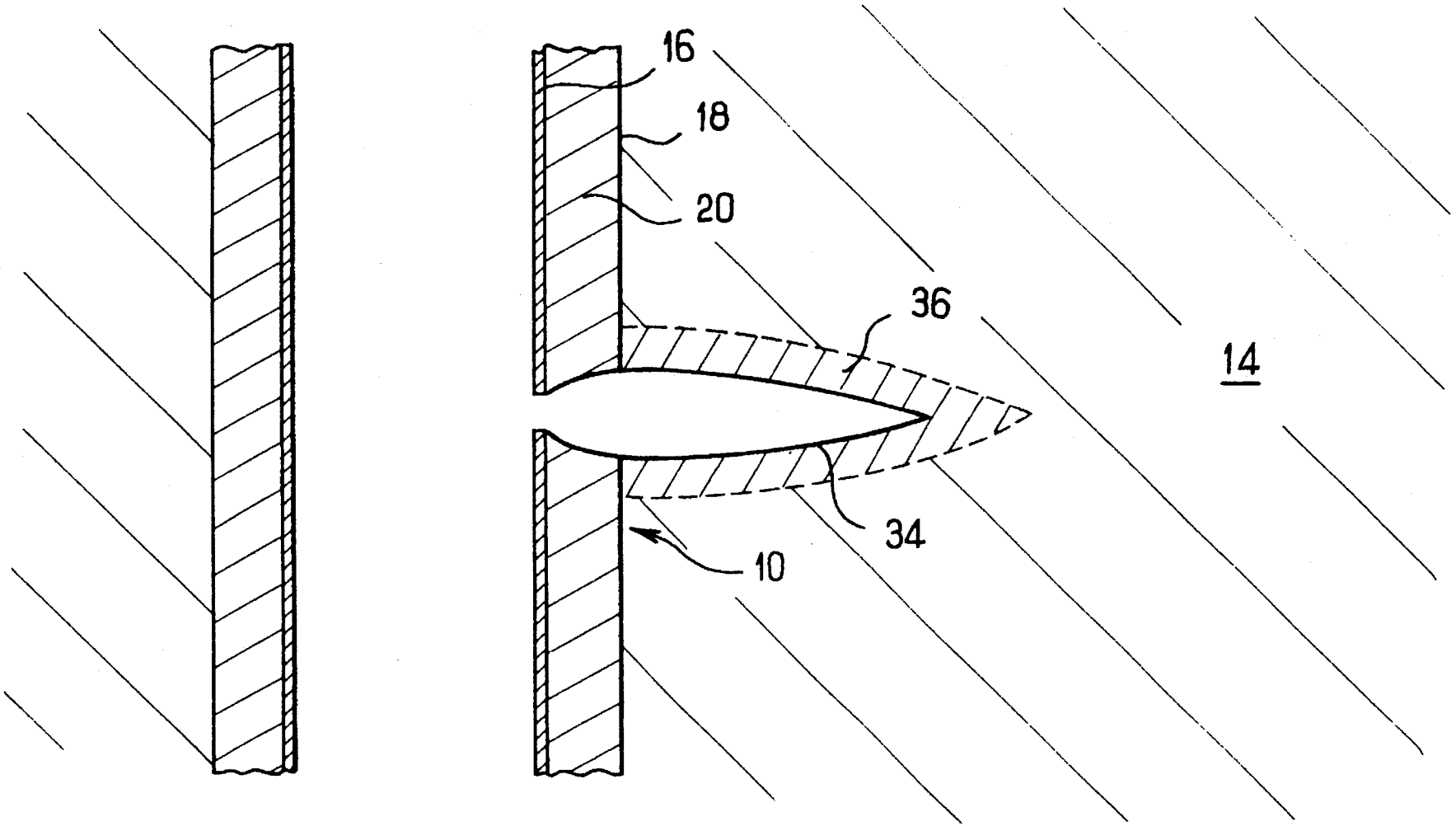
FIG. 2 is a detailed view of an element in FIG. 1.

As better seen in FIG. 2, the perforation 34 is bounded by a damaged region 36 with higher compactness than that of the rock 14, which is formed by the compression of the rock resulting from the explosion. The explosion reduces the size of the rock grains in the damaged region and causes reduction of its permeability. According to the invention, in order to determine whether treatments are necessary to facilitate the flow of the crude oil, an evaluation is carried out of the damage to the region surrounding the perforation.

Figure 3:
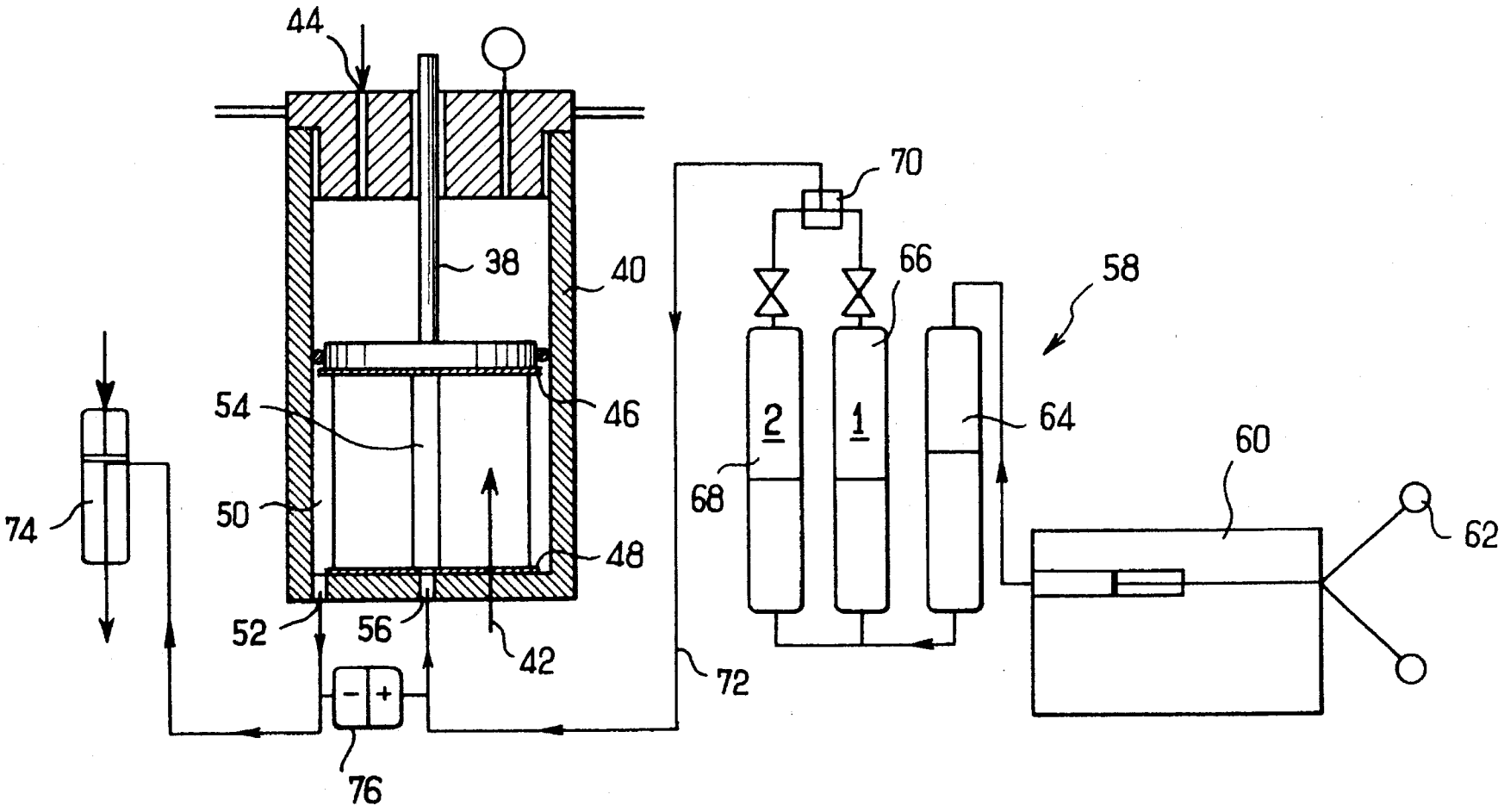
FIG. 3 is a diagram of a device making it possible to implement the method which forms the subject matter of the present invention under laboratory conditions.

A device allowing implementation of the method according to the present invention under laboratory conditions is represented in FIG. 3. A piston 38 and cylinder 40 assembly receives a rock sample 42, of annular cross-section, whose permeability it is desired to measure. The piston 38 slides in leaktight manner in the cylinder 40 under the effect of a hydraulic pressure applied via an inlet 44. The sample 42 is held in leaktight manner in the cylinder 40 using two seals 46, 48 so as to define an annular passage 50 with the internal wall of the cylinder 40, which passage communicates with an outlet 52. A central passage 54 created by a perforation inside the sample 42 communicates with a fluid inlet 56. An oil circuit, represented generally at 58, comprises a pump 60, with constant flow rate, connected to an electricity supply 62, and oil tanks 64, 66 and 68. The tanks 66 and 68, each containing a different oil, can be selectively connected via a set of valves 70 to a pipe 72 leading to the inlet 56. The pressure at the outlet 52 is regulated by a surge valve 74. The pressure gradient between the inlet 56 and the outlet 52 is measured by a measuring device 76.

By way of test, a rock sample was tested in the laboratory.

The sample tested was berean sandstone and was in the form of a hollow cylinder having an external radius Re of 5.05 cm, a thickness H of 2.36 cm and a length of 8 cm. The radial permeability of the sample k(ref) was 174 mD before damage by the perforating shot.

Before carrying out the measurement experiments, the sample is previously cleaned and dried. Oil having a viscosity $\mu_1$= 1.5 cPo is sent from the tank 66 via the pipe 72 to saturate the sample 42 which was previously placed under vacuum.

The porosity of the sample measured during the test with the oil having viscosity 1.5 cPo is 19.4%. The pressure of the oil at the inlet 56 is then increased to 5 bar and the radial permeability Ko measured is equal to 103 mD. At time t= 0, an oil with viscosity $\mu_2$=47.5 cPo is sent from the tank 68 to the inlet 56 with a constant flow rate Q of 18.8 ml/h and the pressure gradient between the central passage 54 and the outlet 52 is recorded as a function of time.

Figure 4:
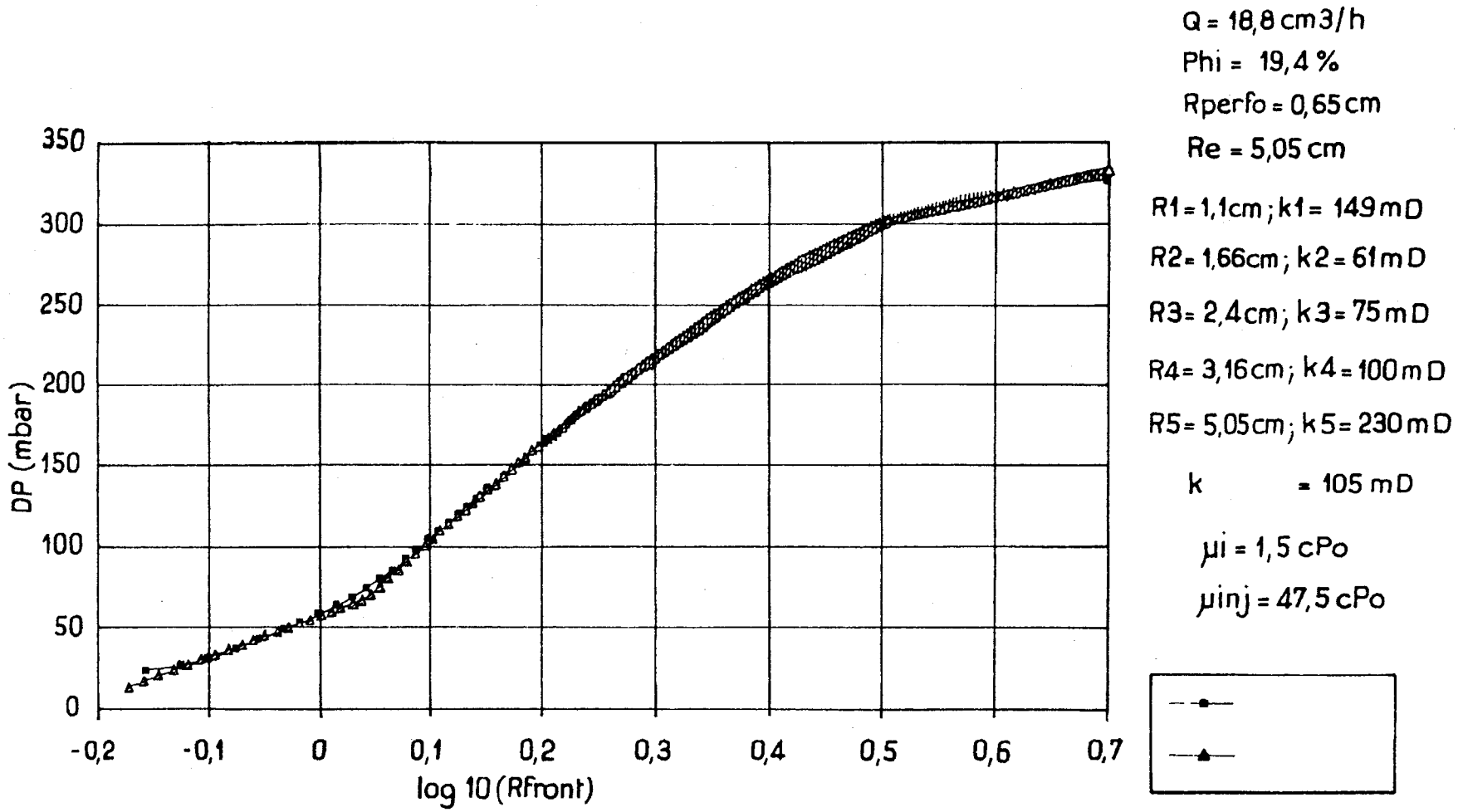
FIG. 4 is a curve of the change in pressure as a function of the theoretical advance of the viscous front.

FIG. 4 shows the change in the pressure applied to the inlet 56 of the sample 42 as a function of the theoretical advance of the viscous front. The curve can be broken down into a number of elementary sections, which are bounded by changes in slope on the curve. These segments correspond to rings with different permeability. These different-permeability rings are again seen in FIG. 5 which shows the change in the permeability with the distance from the axial passage 54.

Figure 5:
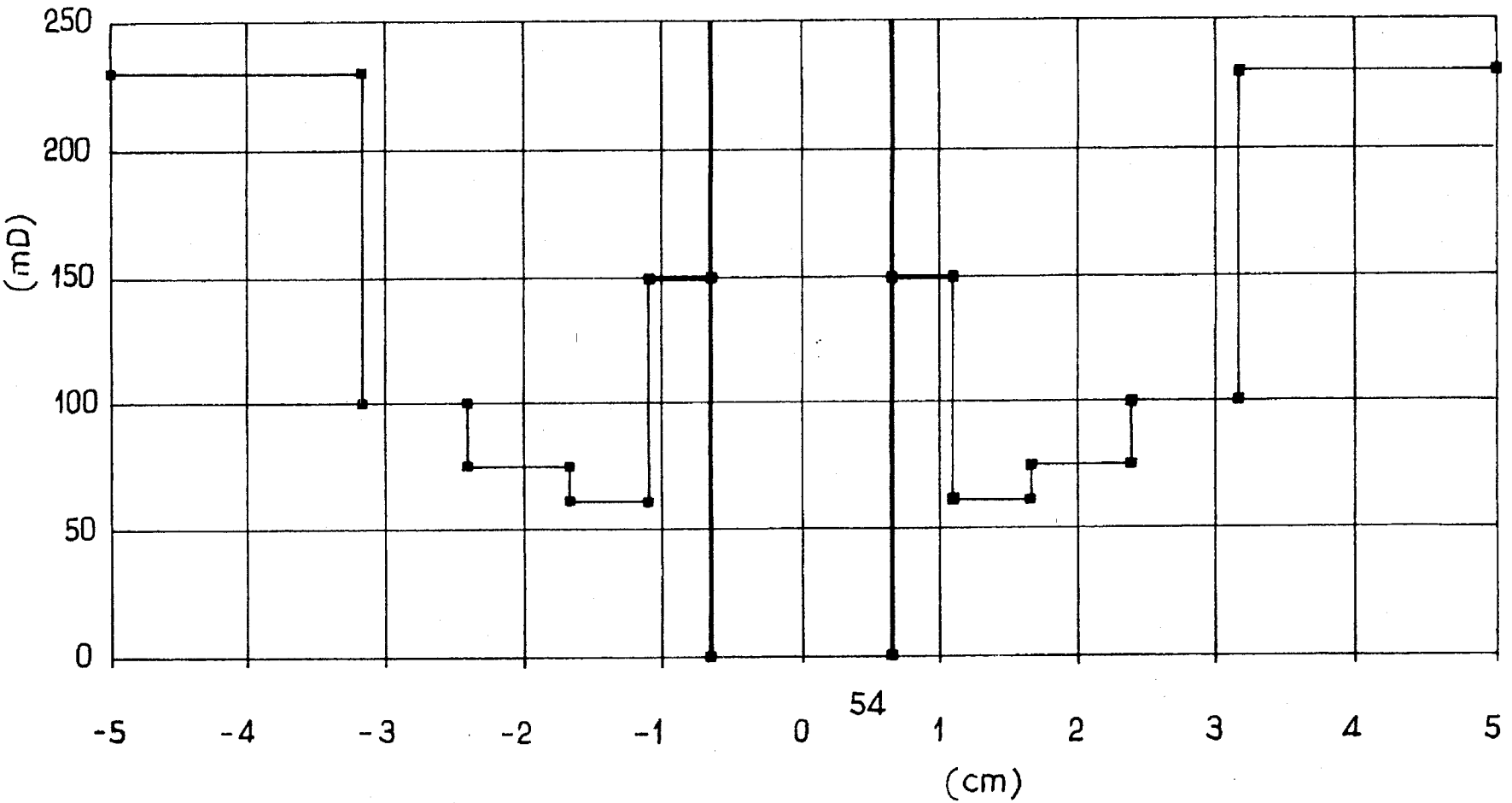
FIG. 5 shows the change in the permeability of the sample with the radial distance.

The curve in FIG. 5 shows 3 separate regions, each corresponding to a section of the curve in FIG. 4:

a region A with thickness 0.5 cm starting from the axial passage 54 and having intermediate permeability, this region being damaged and unconsolidated;

an annular damaged region B with thickness 2 cm and having greatly reduced permeability; and an annular region C with thickness approximately 2 cm and having high permeability, not damaged by the perforation operation.

Figure 6:
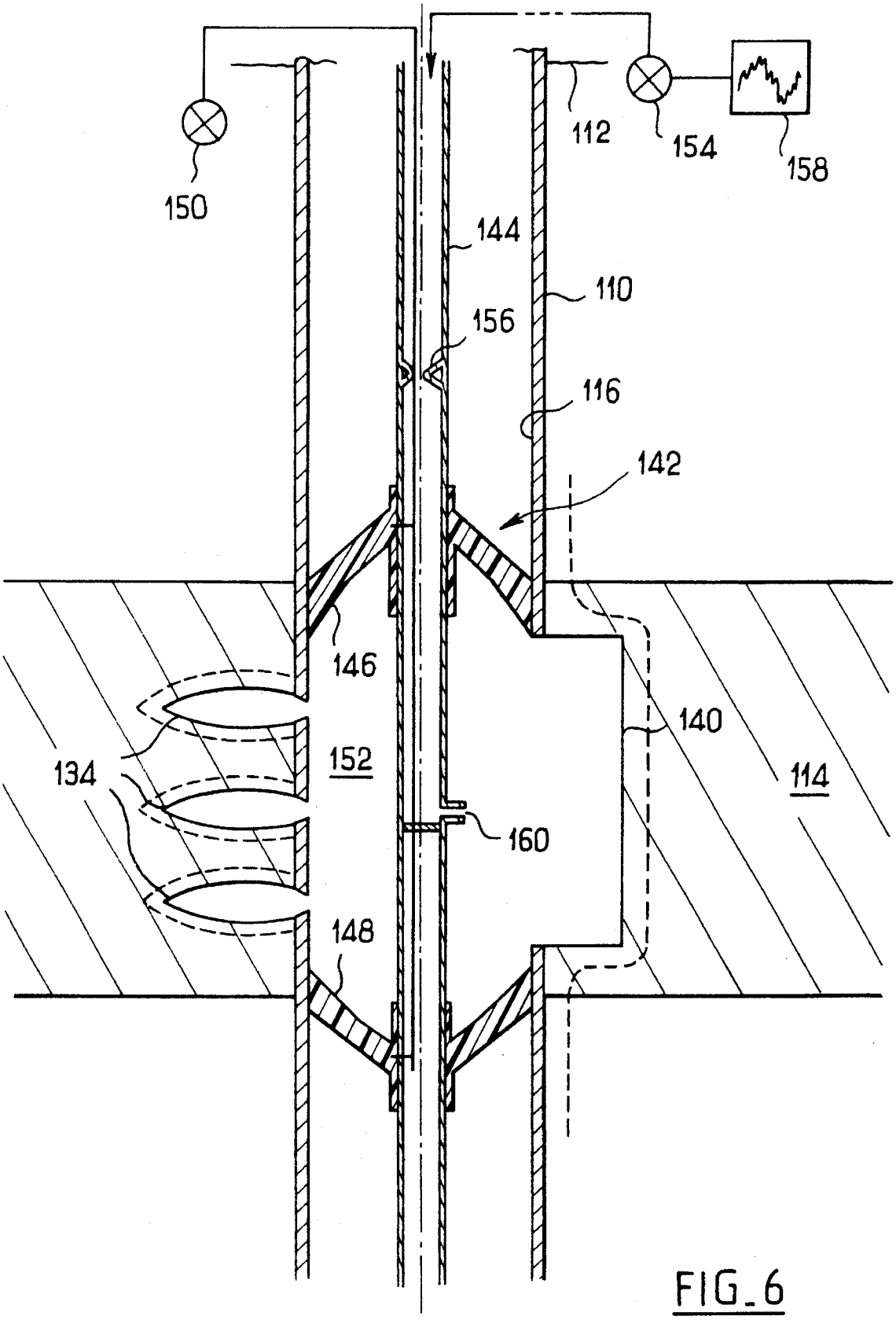
FIG. 6 is a schematic view, in longitudinal section, of an oil well fitted with an apparatus making it possible to implement the method which forms the subject matter of the present invention.

FIG. 6 shows an apparatus making it possible to implement the method according to the invention in an oil well. The well 110 extends from the surface 112 to an oil-bearing rock layer 114 in which perforations 134 have been formed, as illustrated on the right in the figure. A measuring tool, generally represented at 142, is arranged towards the lower end of a production column 144 extending from the surface 112 to the oil-bearing rock layer 114.

The tool 142 comprises an upper seal 146 and a lower seal 148 which, once the tool 142 has been lowered into the well 110 to the level of the layer 114, are connected to a pressurized fluid source 150 arranged at the surface 112 in order to pressurize the seals and ensure leaktightness with the inside of the casing 116. The two seals 146 and 148 define between them a chamber 152 whose wall comprises the damage to be evaluated, which is formed either by the perforations 134 or the window 140.

The interior of the chamber 152 is connected to a pressurized oil source 154 via the interior of the production column 144. The interior of the production column 144 is provided, at a predetermined point, with a constriction 156. The source 154 is connected to a recorder 158 which is intended to record the change in the pressure of the unit, sent via the production column 144. The presence of the constriction 156 in the oil passage causes a rise in pressure which is displayed on the recorder 158 just before oil reaches the chamber 152. The oil enters the chamber 152 through an orifice 160.

The tool 142 is used as follows. Once the production column 144 has been lowered into the well so that the tool 142 lies at the level of the perforations 134 or of the window 140, the two seals 146 and 148 are pressurized from the source 150 in order to ensure that the chamber 152 is isolated from the well 110. The rock to be evaluated is then saturated with a fluid having known viscosity. This first fluid may comprise either the fluid present in the well or the oil in place in the oil-bearing rock. In both cases, the viscosity of the fluid under the conditions at the bottom of the well can be determined by conventional techniques. In an alternative embodiment, in which no suitable fluid is present at the well bottom, the first fluid with known viscosity is sent from the surface via the interior of the production column 144.

Once the rock to be evaluated is saturated with the first fluid, a second fluid, especially an oil, with high viscosity, greater than that of the first fluid, is sent under pressure via the interior of the production column 144 to the chamber 152. The term high viscosity is intended to mean a viscosity between 10 and 100 times greater than that of the first fluid and, preferably, approximately 30 times greater.

The instant at which the high-viscosity oil arrives at the constriction 156 can be detected on the recorder 158 by a rise in pressure. Subsequently, knowing the volume of the production column 144 downstream of the constriction, as well as the volume of the chamber 152, it is possible to determine the moment when the chamber 152, including the volumes of the perforations 134 or of the window 140, is filled with oil, and thus the moment when the saturation of the rock 114 starts.

Figure 7:
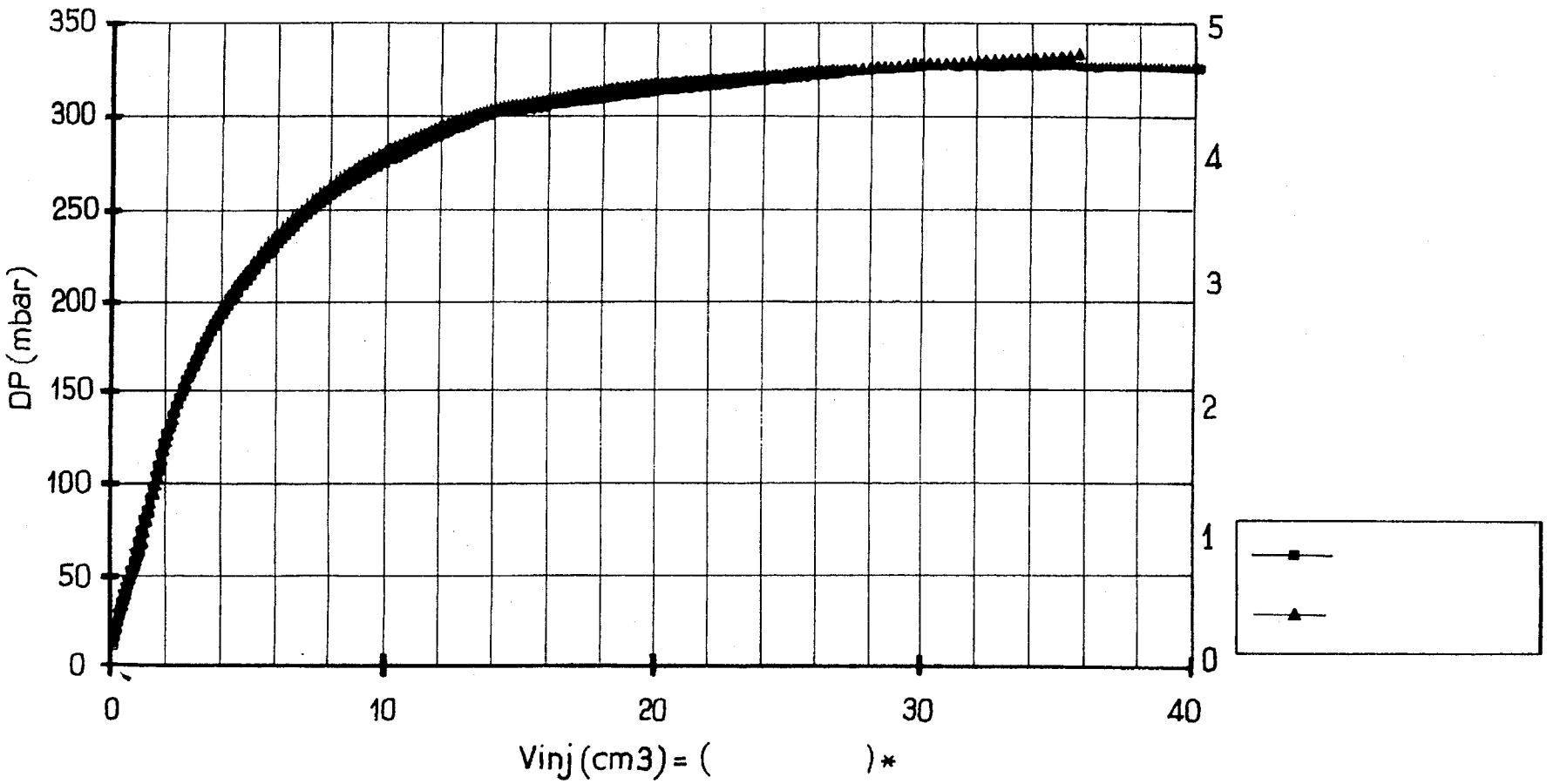
FIG. 7 is a curve of the change in the oil pressure as a function of time.

From the start of the saturation of the rock 114 with constant flow rate, the pressure gradient is recorded as a function of time. The change in the pressure of the oil as a function of time is represented by the curve in FIG. 7, and that of the pressure of the oil as a function of the theoretical radius of advance of the viscous front by a curve similar to that in FIG. 4. The points on this curve where the slope changes indicate associated changes in permeability. The sections joining the slope-change points represent regions of the rock with different permeability. These regions are again found on a curve similar to that in FIG. 5, which shows the change in the permeability with the radial distance from the well.

In a second mode of interpretation, instead of detecting the slope-change points, the derivative of the curve of the pressure gradient as a function of time is plotted in order to generate a curve of the change in the permeability as a function of the distance to the well.

Figure 8:
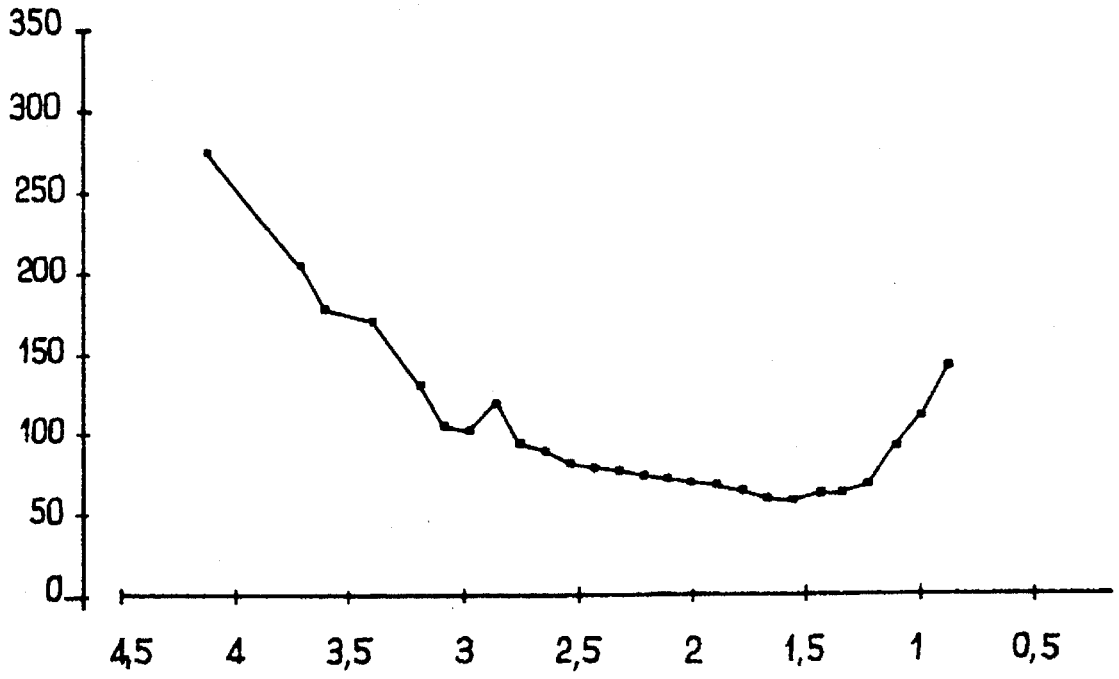
FIG. 8 is a curve which shows, in alternative manner, the change in the permeability with the radial distance.
Figure 8A:
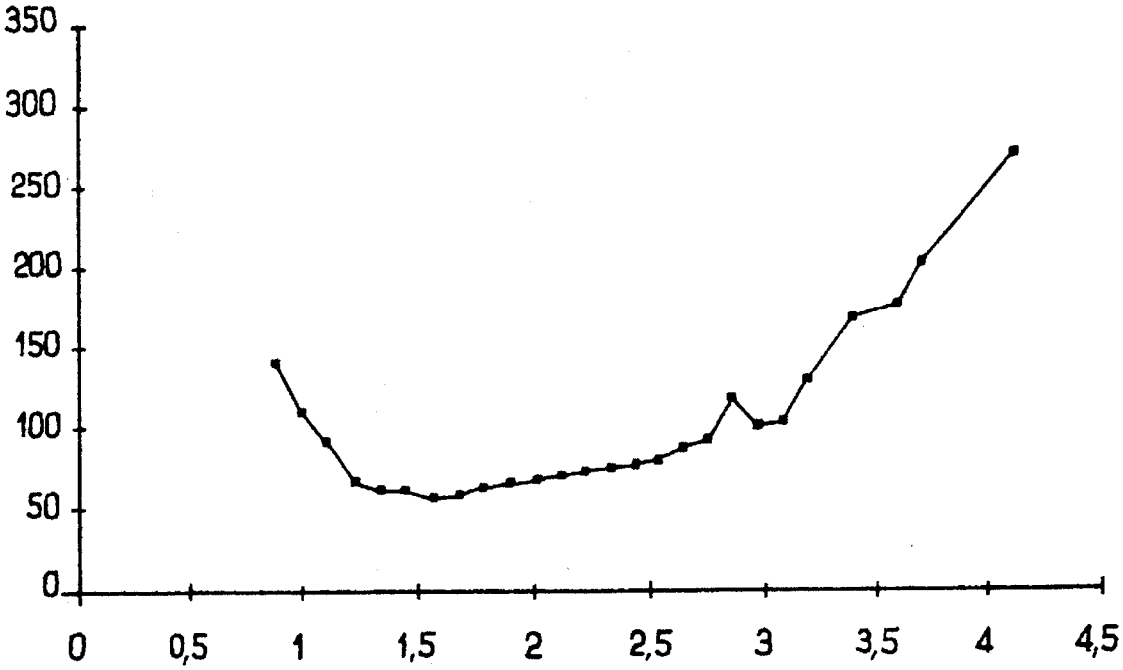

FIG. 8 shows a curve of the change in the permeability, produced using the derivative of the curve in FIG. 4. FIG. 8 thus reproduces the data in FIG. 5 more precisely.

It is possible to use the method according to the invention for determining other characteristics relating to the state of operation of the well, for example for counting the number of perforations present at the bottom of the well.

The distance to the well at time t is defined by the equation $$R(t)=\sqrt{\frac{Qt}{\pi\times H\times\bar{\bar{\phi}}}-Rw^2}$$

The local permeability at time t [therefore at R(t)] is defined by the equation $$k(t)=\frac{Q\,(\mu_1-\mu_2)}{4\times\pi\times H\,\frac{(t+\tau\,Rw^2H\bar{\bar{\phi}})}{Q}\times\frac{d\,P(t)}{dt}}$$

where

Q=injection flow rate

H=thickness of the strata

θ=mean porosity of the strata $R_w$=radius of the well $\mu_1$=viscosity of the initial fluid $\mu_2$=viscosity of the injected fluid ($\mu_2>\mu_1$)

R(t)= radius of the viscous front at time t k(t)= permeability of the front at time t (therefore at R)

p(t)=pressure at time t

I claim:

1. Method for evaluating the damage to the rock structure surrounding a well, comprising:

forming a chamber in the well whose wall comprises the damaged rock structure to be evaluated, said rock structure being saturated with a first fluid having a first viscosity, injecting into the chamber an oil with a viscosity 10 to 100 times higher than the first viscosity, recording the pressure of the injected oil as a function of time, and analyzing the change in the pressure of the injected oil as a function of time in order to deduce the different permeability regions present in the damaged rock structure.

2. Method according to claim 1, wherein the saturation of the rock with the first fluid is due to a fluid already present in the drilling well.

3. Method according to claim 1, wherein the saturation of the rock with the first fluid is carried out from the surface.

4. Method according to claim 3, wherein an oil is used as the first fluid.

5. Method according to claim 1, wherein an oil is used having a viscosity 30 times higher than that of the first fluid.

6. Method according to claim 1, wherein the analysis of the change in the permeability as a function of the distance to the well is carried out by using the time derivative of the curve of the change in pressure of the oil as a function of time.

7. Method according to claim 1, wherein said chamber is defined by an upper and a lower seal placed inside the well casing.

8. Method according to claim 7, wherein said seals are connected to a pressurized fluid source which pressurizes the seals and maintains leaktightness with the inside of the well casing.

* * * * *